United States Patent [19]

Wilson, III

[11] Patent Number: 4,844,314

[45] Date of Patent: Jul. 4, 1989

[54] PULLEY FOR FORMS FEED TRACTOR

[75] Inventor: Joseph T. Wilson, III, Endicott, N.Y.

[73] Assignee: International Business Machines Corporation, Armonk, N.Y.

[21] Appl. No.: 153,742

[22] Filed: Feb. 8, 1988

[51] Int. Cl.[4] ..... B65H 20/20

[52] U.S. Cl. ..... 226/74

[58] Field of Search ..... 226/74, 75, 82, 87; 400/616–616.2; 474/152, 153, 154, 164, 202, 203, 204, 205

[56] References Cited

U.S. PATENT DOCUMENTS

| | | | |
|---|---|---|---|
| 3,825,162 | 7/1974 | Hubbard | 226/74 |
| 4,193,527 | 3/1980 | Rutishauser | 226/74 |
| 4,214,691 | 7/1980 | Van Newman | 226/74 |
| 4,218,932 | 8/1980 | McComber | 474/153 X |
| 4,295,837 | 10/1981 | Marsh | 474/153 |
| 4,453,660 | 6/1984 | Cornell et al. | 226/74 |
| 4,614,508 | 9/1986 | Kerivan | 226/74 X |

*Primary Examiner*—Stanley N. Gilreath
*Attorney, Agent, or Firm*—John S. Gasper

[57] ABSTRACT

A tractor for feeding perforated paper has an endless belt of flexible material having pins and teeth extending in opposite directions from said belt. The belt has more rigid sections corresponding to the locations of the teeth between flexible web sections. A pulley is provided which has curved sections and grooves for receiving the teeth of the belt. The curved sections comprise an arc with ends having points of tangency with planes of straight sections of the belt extending across the grooves. The curved sections may comprise a composite arc having end arc sections with points of tangency with the planes of the straight sections of the belt and a center arc section having points of tangency with the end arc sections. The curved sections may also be an arc which has a continuously increasing radius of curvature from the points of tangency with the planes of the straight sections of the belt to a center line between the grooves.

11 Claims, 5 Drawing Sheets

PULLEY FOR FORMS FEED TRACTOR

FIELD OF THE INVENTION

This invention relates to belt drive apparatus and particularly to a pulley device for driving toothed timing belts or the like. The invention is especially related to a pulley device used in combination with a toothed pin belt in tractor feed mechanisms for a printer.

BACKGROUND OF THE INVENTION

Timing belts have been formed by molding or casting an elastomer over tension members to form teeth and the body of the belt. Some timing belts are formed by attaching teeth to a thin metal or polymer band or by molding belts without internal tension elements. The pulley for driving such belts is a cylinder with grooves formed in the periphery to mesh with the teeth so as to allow the inside surface of the belt to ride on the periphery of the pulley. Examples of various types of belts and pulleys are shown in U.S. patents are U.S. Pat. Nos. 4,295,837; 4,218,932; 4,214,691; 4,193,527; 3,825,162; 4,614,508; and 4,453,660.

One problem with such belts is that they break long before they are expected to wear out in spite of being made from long wearing materials. The breaking invariably occurs in the relatively thin, flexible sections, sometimes called the web section, between the relatively thick and rigid toothed sections. It has been discovered that the breaking of the web is the result of fatigue caused by repeated bending of the belt as it wraps around the pulley during use. This problem is especially severe in tractor feed mechanisms used in high speed printers where the diameter of the pulley is relatively small and the peripheral speed is high and the belt is also being subjected to rapid tension and contraction forces as a result of rapid acceleration and deceleration of the pin belt. The cause of the problem was found to be that the contour of the belt as it wraps around the pulley is a series of arcs and straight sections instead of a constant radius. Because the periphery of the pulley is a circular cylinder with grooves, the arcs are not tangent to the straight sections and high bending stresses develop where the straight and curved sections meet. The resulting bending stresses cause belt failures. Prior attempts to solve the problem depended on use of pulley structures having raised projections between the grooves which raise the belt above the normal surface of the pulley. In addition to making a pulley structure more complicated, the belt is still subjected to being flexed as it goes through a series of straight and curved sections which can still produce fatigue. This is especially so with thin steel or plastic bands.

SUMMARY OF THE INVENTION

In accordance with the invention, a pulley device for driving a toothed belt is provided in which the severed bending stresses produced in the vicinity of the edge of the toothed section of the belt are eliminated. Basically, the invention contemplates providing a cylindrical pulley having a periphery which is made of alternate grooves and convex curved surface sections. Grooves are formed for receiving and meshing with drive teeth. The shape of the grooves corresponds with the shape of the teeth so that the teeth reside in the grooves whereby the thin flexible web portions of the belt are fully supported by the convex curved surface sections between the grooves and the rigid toothed portions form straight sections across the grooves. According to the invention, the ends of the curved surface sections are made to be tangent to the planes of said straight sections of the belt. Between their ends, the curved surface sections have an arc length which completes the pitch length of the belt. In this manner, the belt experiences no fatigue bending as it wraps around the pulley. In one embodiment, the curved surface sections comprise a convex arcuate surface whose radius of curvature is less than the radial distance measured from the rotational center of the pulley to the plane of the straight sections through the center of the grooves. The ends of this arcuate surface are tangential to the planes of the straight sections. In a second embodiment, the convex curved surface sections comprise a composite of a plurality of mutually tangent convex arcuate surfaces including end arcuate surfaces which are tangent with the planes of the straight sections. In a specific form the mutually tangent convex arcuate surfaces comprise a single center arcuate surface between two end arcuate surfaces. The end arcuate surfaces are tangential to the planes of the straight sections. The single center arcuate surface is a circular convex arcuate surface tangential to the end arcuate surfaces. A third embodiment, the curved surface sections comprise a convex arcuate surface having a continuously changing radius of curvature with the ends thereof tangential to the planes of the straight sections at or near the edges of the grooves. With such a pulley, sharp bends in the belt as it wraps around the pulley are essentially eliminated along with related fatigue failures. In addition, such a pulley is easier to fabricate. No additional structures are required on the periphery of the pulleys between the grooves.

The foregoing and other objects, features and advantages of the invention will be apparent from the following more particular description of preferred embodiments of the invention, as illustrated in the accompanying drawing.

DETAILED DESCRIPTION OF THE INVENTION

Figure 1:
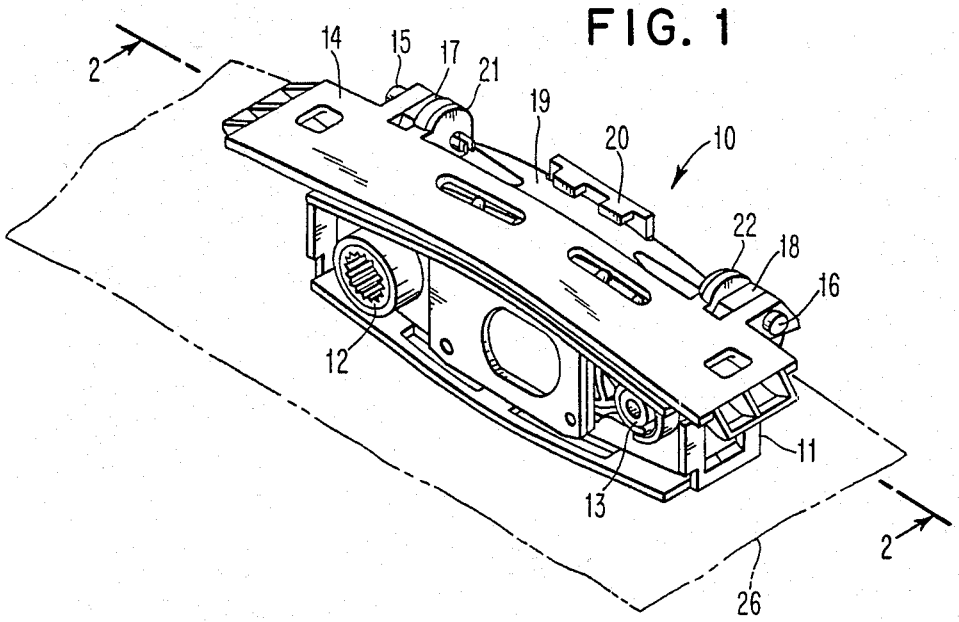
FIG. 1 is a three dimensional view of a tractor feed mechanism for using the invention.
Figure 2:
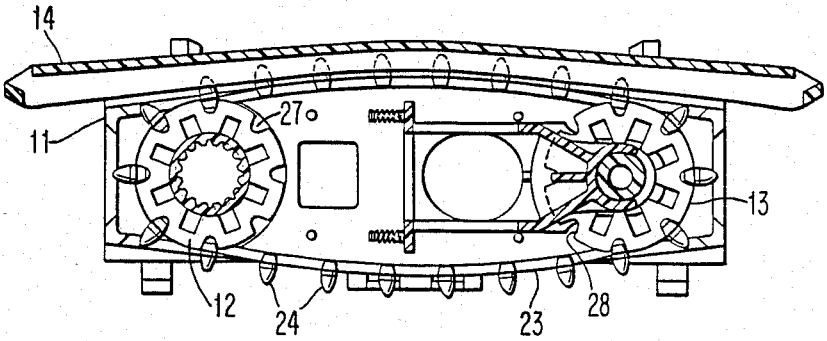
FIG. 2 is a side elevation section taken along line 2—2 of FIG. 1.

Referring to FIGS. 1 and 2, there is shown a tractor feed mechanism 10 having a body 11 on which are journaled pulleys 12 and 13. Pulley 12 is driven by a drive shaft (not shown). Pulley 13 is an idler pulley. A door 14 is connected by hinge pins 15 and 16 to hinge posts 17 and 18 of the tractor body 11. A flat spring 19 simply supported on a platform 20 of body 11 operates on rotary cams 21 and 22 which part of the hinge elements of door 14 the door in either the closed position as shown or in an open position.

Figure 3:
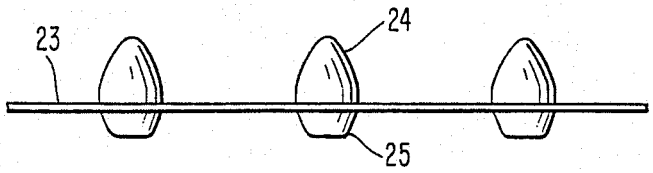
FIG. 3 shows a fragment of a timing belt of the type used in the tractor mechanism of FIG. 1.

As shown in FIG. 2, a feed belt is entrained around pulleys 12 and 13. One type of feed belt comprises a continuous flexible band 23 with feed pins 24 on the outside and gear teeth or lugs 25 on the inside. (See also FIG. 3). The function of the feed pins 24 is to engage individual perforations in a row of perforations (not shown) along one edge of a continuous paper form 26 or the like which is fed through a printer of which tractor 10 is a part. As is well known, the spacing of the feed pins 24 is the same as the perforations in paper 26. The function of the gear teeth 25 is to be engaged by the pulleys which imparts drive motion thereto for feeding paper 26. The pulleys 12 and 13 have grooves 27 and 28 respectively around their outer peripheries which receive gear teeth 25. In the course of rotation, the gear teeth become enmeshed in the grooves as band 23 is wrapped around the pulleys. To assure proper meshing of gear teeth and grooves, the arc length of the pulleys must match the pitch of the belt. Arc length is defined as the arc distance between the centers of adjacent grooves measured at the center of the web. Belt pitch is defined as the linear distance between the centers of the gear teeth along a line through the center of the web portion of the belt.

Figure 4:
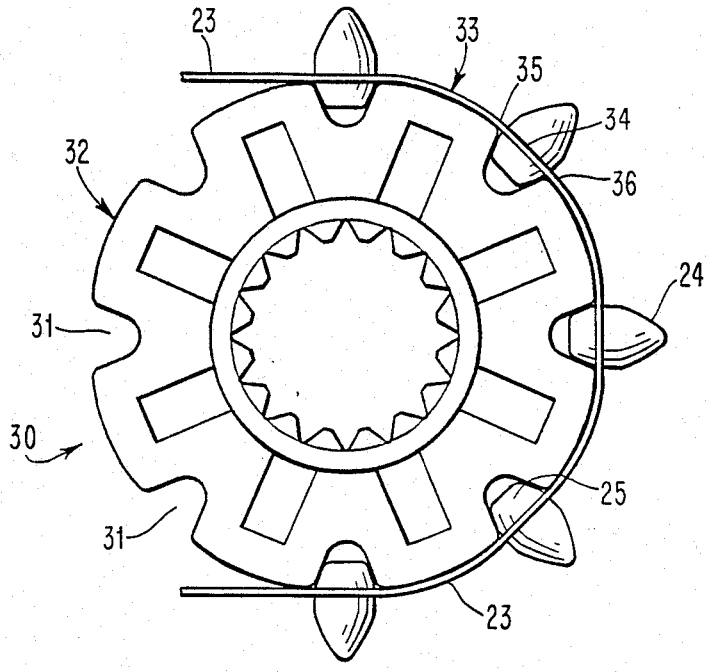
FIG. 4 PRIOR ART
FIG. 4 shows a prior art pulley device with a timing belt.
Figure 5:
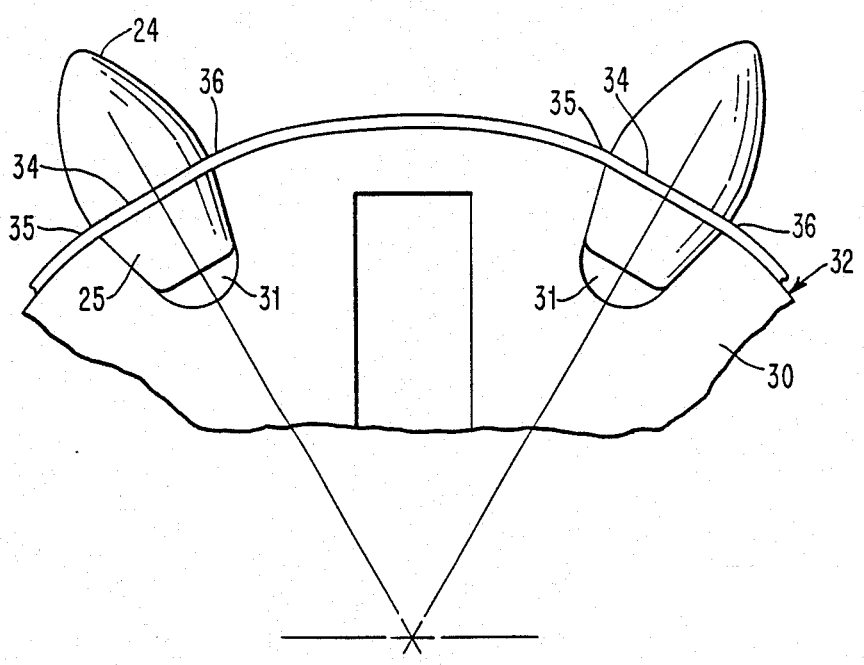
FIG. 5 PRIOR ART
FIG. 5 is a schematic of a portion of the timing belt and pulley of FIG. 4 illustrating the bending of the belt around a pulley in a series of arcs and straight sections which produce the bending stress problems.

Referring now to FIGS. 4 and 5, there is shown a prior art pulley 30 for a pin feed belt. This pulley is a circular cylinder on which the inside surface of band 23 rides. Grooves 31 are cut into the periphery 32 of the cylinder 30 at a predetermined pitch so as to mesh with the teeth 25. Because the toothed sections of the belt are much more rigid than the web sections between the teeth, band 23 flexes very little in the toothed sections. The result is that instead of bending at a constant radius, more or less corresponding to the constant cylinder radius of the pulley 30, the band 23 is a series of arcs 33 across the pulley surface 32 and straight sections 34 across the grooves 31. Because the periphery 32 of pulley 30 is a series of arcs of circular cylinder with grooves 31, band 23 experiences some sharp bends such as at 35 and 36 which, repeated each time it is wrapped around pulley 30, ultimately produces fatigue stresses and failure.

Figure 6:
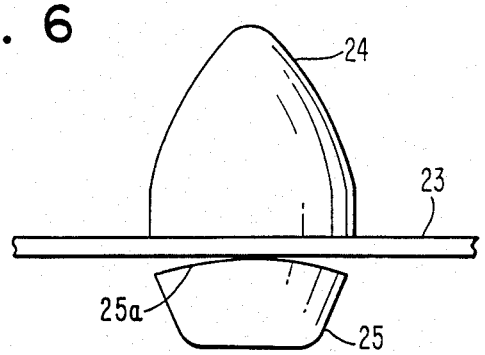
FIG. 6 is an enlargement of a portion of the timiing belt of FIG. 3.

One solution for reducing these stresses is illustrated in the tractor belt shown in FIG. 6. There a radius 25*a* is applied to the top of tooth 25 under band 23. This radius which should match the radius of the pulley, reduces the bending stresses, but it also makes the connection between tooth 25 and band 23 weak. This is also difficult to fabricate in the case where the tooth is molded.

The invention provides a pulley design for reducing belt stresses. Instead of forming the pulley as a circular cylinder with grooves, it is formed as a cylinder with grooves joined by convex curved surface sections the ends of which are tangent with the planes of the straight sections of the belt extending across the grooves. The ends of the curved surface sections are tangent to the planes of the straight sections, and between the ends, the curved surface sections have a radius with centers that may not be coincident with the pulley center.

Figure 7:
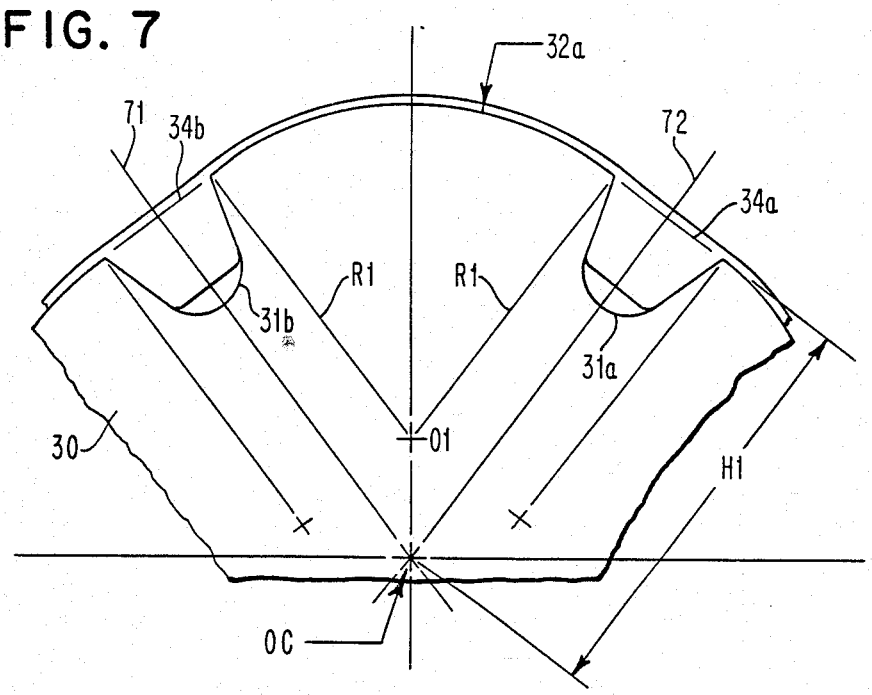
FIG. 7 is a schematic of a fragment of a pulley showing a first embodiment of a pulley incorporating the invention.

One form in which the invention is practiced is shown in FIG. 7. There is a curved surface section 32*a* of a single radius R1 with center 01 and that is tangent to the adjacent straight sections 34*a* and 34*b* of the belt extending across the grooves 31*a* and 31*b*. Tangency of curved surface section 32*a* with straight sections 34*a* and 34*b* occurs at the edges of grooves 31*a* and 31*b*. H1 is the radius of the center of grooves 31*a* and 31*b* and is normal to the straight sections 34*a* and 34*b*. The magnitudes of R1 and H1 are chosen to obtain tangency at the edges of grooves 31*a* and 31*b* and an arc length between the centerlines T1 and T2 of the grooves 31*a* and 31*b* which matches the belt pitch. In this embodiment, although the arc length between centerlines T1 and T2 of grooves 31*b* and 31*a* matches the belt pitch, the belt can be subject to a certain amount of longitudinal tensile stress because the center 01 of radius R1 for curved section 32*a* is not coincident with center OC of pulley 30. Some such stress however is tolerable provided the stress does not exceed limits of belt strength and extensibility.

Figure 8:
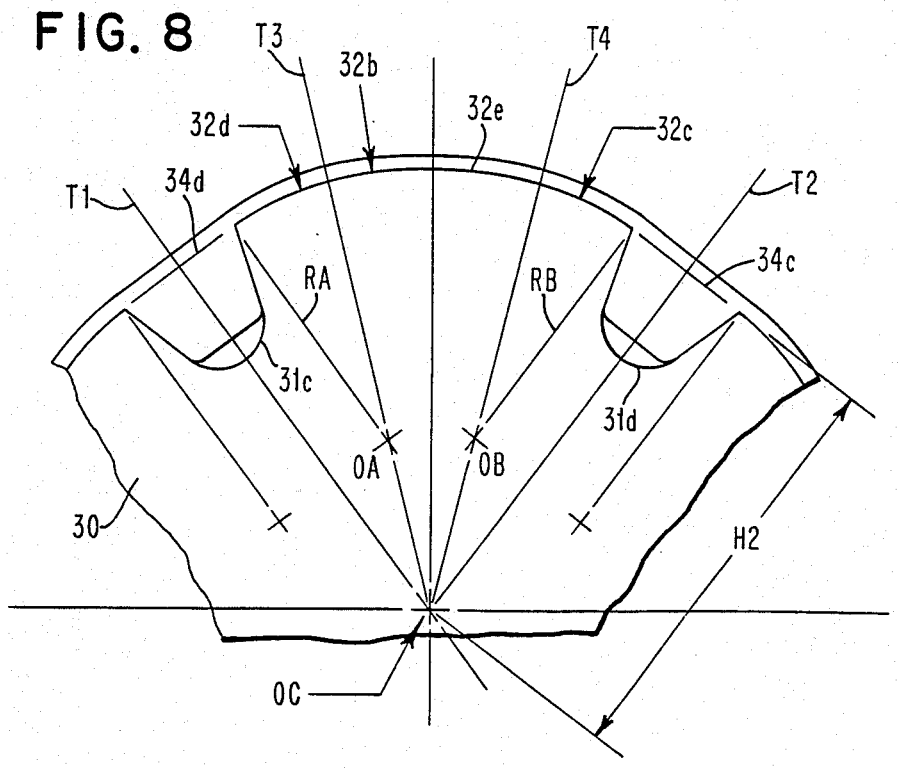
FIG. 8 is a schematic of a pulley according to a second embodiment of the invention.

A more accurate embodiment for reducing the aforementioned longitudinal stress is shown in FIG. 8. There the curved surface section 32*b* between grooves 31*c* and 31*d* is a composite of a plurality of mutually tangent arcuate surfaces and is comprised of three arcuate surface sections, end arcuate surface sections 32*c* and 32*d*, and center arcuate surface section 32*e*. In this embodiment, end arcuate surface sections 32*c* and 32*d* have outer ends that are tangent with the planes of the straight sections 34*c* and 34*d* of the belt extending across grooves 31*c* and 31*d*. The center arcuate surface section 32*b* is mutually tangent with the inner ends of end arcuate surface sections 32*c* and 32*d*. The radii RA and RB for end arcuate surface sections 32*d* and 32*c* respectively are on centers OA and OB and are equal, i.e RA=RB. H2 is the length of the center lines T1 and T2 which are normal to straight sections 34*c* and 34*d*. The center OA is on line RA which is parallel with the center line T1 of groove 31*c*. Center OB is on line RB which is parallel with center line T2 of groove 31*d*. In this case, the center for center arcuate surface section 32*b* is coincidental with the center OC of the pulley. Center OA is on line T3 from the pulley center OC. Likewise, center OB is on line T4 from OC. The construction, indicated, assures the necessary tangency between the various curved surface and straight sections 34*c* and 34*d* of the belt. There is the additional degree of freedom with this embodiment in that the values of RA, RB and H2 may be varied to obtain the arc length between T3 and T4 which matches belt pitch. In the embodiments shown in FIGS. 7 and 8, the edges of the grooves are shown with sharp edges at the point of tangency. As a practical matter the edges of the grooves may be rounded with a small radius r (not shown). The radius r should be relatively small to obtain tangency in close proximity to the groove edge. The limit of radius r is expressed by the ratio r/R where R is the radius of the tangent radii.

Figure 9:
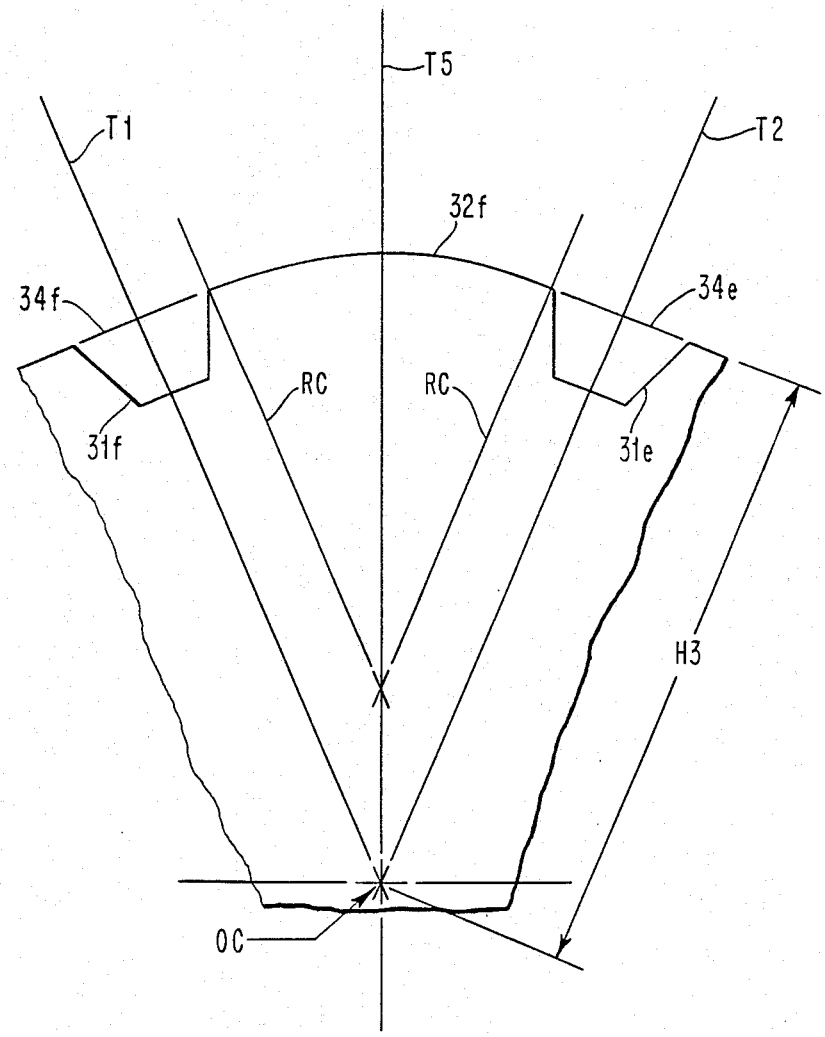

In a further refinement of the invention as shown in FIG. 9, the curved surface section 32*f* between the straight sections 34*e* and 34*f* of the belt extending across grooves 31*e* and 31*f* may be an arcuate surface the contour of which comprises a curve having a continuously changing radius of curvature. Such curves are commonly known as cam curves and are essentially produced as an infinite number of arcs each having a different radius RC which in this case increases from the where the ends of curved surface section 32*f* is tangent with with the planes of the straight sections 34*e* and 34*f* to the center line T5 (see FIG. 9). In this case, the arc length consisting of curved surface section 32*f* plus the straight distances from the ends thereof to centerlines T1 and T2 of grooves 31*e* and 31*f* matches the the belt pitch and further reduces longitudinal tensile stress on the belt during pulley rotation.

On the basis of the invention, pulleys are produced which reduce belt breakage. If the pulley is molded, the noncircular contour is easily designed without added costs.

While the invention has been particularly shown and described with reference to a preferred embodiment(s) thereof, it will be understood by those skilled in the art that various changes in form and details may be made therein without departing from the spirit and scope of the invention.

What is claimed is:

1. In a tractor for feeding perforated paper or the like and having an endless belt of flexible material having pins and teeth extending in opposite directions from said belt, said belt having rigid sections between flexible web sections, said rigid sections corresponding with the locations of the teeth on said belt, said pins being receivable in said perforations of said paper, and a pulley for driving said endless belt, the improvement comprising said pulley comprising a cylindrical body having a periphery with alternating convex curved surface sections and radial grooves, said radial grooves being formed for receiving said teeth of said belt whereby said web sections of said belt rest on said curved surface sections and said rigid sections extend in straight sections across said grooves, and said curved surface sections of said pulley comprising a convex arcuate surface having the ends thereof tangent to the planes of said straight sections, whereby the arc length of said arcuate surface plus the distance to the centers of said grooves equals the pitch of said teeth on said belt.

2. In a tractor in accordance with claim 1, wherein said convex curved surface sections of said pulley comprise convex arcuate surface that has a constant radius of curvature and ends that are tangent to said planes of said straight sections.

3. In a tractor in accordance with claim 2 wherein said constant radius of curvature of said arcuate surface has its center of rotation located at a point on the center line extending from the center of said pulley.

4. In a tractor in accordance with claim 1 wherein said curved surface sections of said pulley comprise a composite of a plurality of mutually tangent convex arcuate surface sections, including end arcuate surface sections tangent with said planes of said straight sections.

5. In a tractor in accordance with claim 4 wherein said plurality of mutually tangent arcuate surface sections comprises said end arcuate surface sections, and a single center convex arcuate surface section tangent with said end arcuate surface sections.

6. In a tractor in accordance with claim 5 wherein said end arcuate surface sections have radii with centers on lines parallel to the center lines of said grooves which are normal to said planes of said straight sections, and said center arcuate surface section has a radius having a center on lines through each of said centers of said radii of said end arcuate surface sections.

7. In a tractor in accordance with claim 1 wherein said curved surface sections of said pulley comprise a convex arcuate surface having a continuously changing radius of curvature from said ends thereof which are tangent with said planes of said straight sections to a center line between said straight sections.

8. In a drive mechanism having a flexible member with longitudinally spaced drive elements and a pulley with grooves spaced along the periphery thereof which receive and engage said drive elements as said pulley rotates, the improvement comprising said pulley having convex curved surface sections around said periphery between said grooves whereby said member has arcuate and straight sections when wrapped around said pulley with said straight sections occurring across said grooves, and said curved surface sections of said pulley being formed to be tangent to the planes of said straight sections at the edges of said grooves whereby the degree of bending of said member between said arcuate and straight sections is minimized.

9. In a drive mechanism in accordance with claims 8 wherein said curved surface sections of said pulley comprise a composite of a plurality of mutually tangent arcuate surface sections having end arcuate surface sections with outer ends tangent with said planes of said straight sections, and a single center arcuate surface section of constant radius and having ends tangent with the inner ends of said end arcuate surface sections.

10. In a drive mechanism according to claim 8 wherein said curved surface sections of said pulley comprise a convex arcuate surface which has a continuously increasing radius of curvature from the edges of said grooves where said arcuate surface is tangent with said planes of said straight sections to a center line between said grooves.

11. In a drive mechanism according to claim 8 wherein said member with said drive elements comprises a thin band of flexible stee and said drive elements include gear teeth attached thereto, said gear teeth being shaped to enter said grooves of said pulley, said gear teeth having a pitch corresponding to the arc length of said curved surface sections plus the distance to the centers of said grooves of said pulley.

* * * * *